United States Patent [19]

Everhardus et al.

[11] Patent Number: 4,587,193

[45] Date of Patent: May 6, 1986

[54] COPYING PROCESS WITH PATTERNED CHARGE INJECTION INTO CHARGE TRANSPORT LAYER

[75] Inventors: Roelof H. Everhardus, Lomm; Theodorus J. H. Siebers, Horst; Martinus B. G. M. Biermans, Belfeld, all of Netherlands

[73] Assignee: Oce-Nederland, B.V., Ma Venlo, Netherlands

[21] Appl. No.: 713,873

[22] Filed: Mar. 20, 1985

[30] Foreign Application Priority Data

Mar. 23, 1984 [NL] Netherlands ..... 8400922

[51] Int. Cl.[4] ..... G03G 13/22; G03G 5/14

[52] U.S. Cl. ..... 430/126; 430/31; 430/56; 430/58; 430/59; 430/60

[58] Field of Search ..... 430/31, 56, 58, 59, 430/60, 126

[56] References Cited

U.S. PATENT DOCUMENTS

| | | | |
|---|---|---|---|
| 2,917,385 | 12/1959 | Byrne | 430/60 X |
| 3,337,339 | 8/1967 | Shelling | 430/60 X |
| 3,341,326 | 9/1967 | Shelling | 430/60 X |
| 3,676,118 | 7/1972 | Mott et al. | 430/56 X |
| 4,369,242 | 1/1983 | Armilli et al. | 430/58 |

FOREIGN PATENT DOCUMENTS

| | | | |
|---|---|---|---|
| 18742 | 11/1980 | European Pat. Off. . | |
| 57-109953 | 7/1982 | Japan | 430/58 |
| 940577 | 10/1963 | United Kingdom . | |

OTHER PUBLICATIONS

Gamblin, "Electrophotographic Halftone System", IBM Tech. Discl. Bull., vol. 18, No. 10, Mar. 1976.

*Primary Examiner*—Roland E. Martin

*Attorney, Agent, or Firm*—Reed Smith Shaw & McClay

[57] ABSTRACT

A copying process in which a pattern of charged and uncharged areas is superimposed on a charge image by charging and exposing image-wise an electrophotographic element which is provided with a charge-transporting top layer having therebeneath a charge-generating layer which can inject charges into the charge-transporting top layer at areas corresponding to said pattern of uncharged areas, but cannot inject charges into the other areas of the charge-transporting top layer. The charge image is developed with a developing powder having a resistivity of less than $10^{12}$ ohms·cm and the resulting powder image is transferred to a receiving material and fixed thereon. The pattern of charged and uncharged areas is provided to produce a uniform light-grey image where desired.

6 Claims, No Drawings

COPYING PROCESS WITH PATTERNED CHARGE INJECTION INTO CHARGE TRANSPORT LAYER

FIELD OF THE INVENTION

The present invention relates to a process for producing copies, and in particular to a process involving the image-wise exposure of an electrophotographic element having a charge-generating layer which upon exposure injects charges into the first areas of a charge-transporting top layer but not into the second areas of the charge-transporting top layer.

BACKGROUND OF THE INVENTION

A method of producing copies using an electrophotographic process has been disclosed in the prior art. Typically, in the electrophotographic process, an insulating, photoconducting surface is charged and after image-wise exposure, the image is developed with a toner and then transferred to a piece of paper, producing the finished copy.

An example of a prior art electrophotographic copying process is described in United Kingdom Pat. No. 940,577. This patent utilizes a photoconductive layer applied to a conductive support. The photoconductive layer has a pattern of areas. After charging, these areas of the photoconductive layer discharge more rapidly than the surrounding areas resulting in a pattern of small charged areas. Image-wise exposure of the photoconductive layer discharges some of the small charged areas forming a charge image in which the image portions are divided up into a large number of small charged areas.

The edges of the charge image are developed equally by an electrically conductive developing power. If the pattern of areas has been chosen to be sufficiently fine, a homogeneously developed powder image will be formed. Without the pattern of more rapidly discharging areas, the edges of the powder image would be developed more than the centers. This difference in the amount of developing would be visible on the copy in the form of a darker edge around the lighter image, particularly in the larger portions of the image.

Another prior art electrophotographic process is described in European Pat. No. 18,742. This patent also forms a pattern of charge areas in a charge image. The pattern of charge areas is produced by exposing a charged photoconductive element to homogeneous light passed through a screen, or by including a screen in the photoconductive element. The maximum density of the charge image portion is increased upon development with a conductive developing powder because of the pattern of charge areas.

Other possible prior art includes IBM Technical Disclosure Bulletin, Vol. 18, No. 10, March 1976 pages 3164–3165 and Xerox Disclosure Journal, Vol. 5, No. 2, March–April 1980 page 131.

While the electrophotographic processes described in the above references generally produce suitable copies, they have the distinct disadvantage that charge image portions corresponding to the light-gray parts of the original are either developed unevenly or not at all. This uneven development occurs primarily in the processes in which the charged photoconductive element contains a pattern of conductive areas or is exposed to homogeneous light passed through an optical screen.

Further, those processes utilizing a screen in the form of electrically insulating areas located on or in a photoconductive layer have the disadvantage that they cannot produce copies with a completely white background except by a long exposure. Complete discharge of this kind of photoconductive layer becomes difficult the shorter the length of exposure because the photoconductive layer discharges upon exposure from the top downward.

It is, therefore, an object of the present invention to obviate these disadvantages by providing a copying process which reproduces homogeneously without an extra long exposure not only the black areas of an original but particularly the light-grey and white areas. This ability to reproduce homogeneously the light-grey and white areas of an original is particularly important for copying drawings which require as white a background as possible and which also contain thin lines that are reproduced as grey due to the loss of contrast caused by the optical system used in the copying process. Moreover, in the extreme case in which a copy is required of a very low-contrast pencil drawing, which cannot be copied on a white background, it is possible with the present invention to produce a copy with an acceptable light-grey background because the background is uniformly reproduced.

SUMMARY OF THE INVENTION

Generally the present invention provides a process for producing copies in which a charge image having a pattern of charged and uncharged areas superimposed thereon is formed by charging and exposing image-wise an electrophotographic element containing a support and having thereon a pattern of photoconductive first areas and second areas which are non-photoconductive or relatively non-photoconductive under the influence of light with respect of which the first areas are photocondutive. The electrophotographic element comprises a charge-transporting top layer having therebeneath a charge-generating layer which upon exposure injects charges into a plurality of first areas of the charge-transporting top layer, but does not inject charges into a plurality of second areas of the charge-transporting layer. The charge image is then developed with a developing powder having a resistivity of less than $10^{12}$ ohms·cm and the resulting powder image is transferred to a receiving material and is fixed thereon.

The excellent reproduction of the light-grey portions and the completely white background of the original results from the presence of the top layer which is insensitive to light or has very little light sensitivity. In the first areas of the charge-transporting top layer, in which charge injection is possible from the underlying charge-generating layer, the overlying charge is rapidly discharged upon exposure to light because charge carriers migrate from the charge-generating layer to the surface of the charge-transporting top layer and neutralize the overlying charges.

Initially, the migrating charges travel perpendicularly to the charge-transporting top layer. As soon as the charges have been neutralized in the first areas, the charge carriers from the charge-generating layer no longer all migrate perpendicularly to the surface but also migrate partly to the edges of the second areas where charge is still present. As the amount of light or length of exposure is increased the charged surfaces of the second areas become increasingly smaller until they have become too small to be able to trap a developer particle. This results in a completely white background on the copy.

PREFERRED EMBODIMENTS

The present invention particularly provides a copying process utilizing an electrophotographic element comprising a support having thereon a pattern of photoconductive first areas and second areas which are non-photoconductive or which are hardly photoconductive relative to the first areas. Upon the support is a charge-transporting top layer and a charge-generating under layer which upon exposure to light injects charges into the first areas of the charge-transporting top layer but does not inject charges into the second areas of the charge-transporting layer.

In the process described in the invention, charge injection by the charge-generating layer into the second areas of the charge-transporting top layer can be prevented in numerous ways. Preferably the charge-generating layer is interrupted or does not contain any charge-generating substance in the areas corresponding to the second areas of the charge-transporting top layer. Another means of preventing the charge injection is a blocking screen disposed beneath the charge-generating layer or between the charge-generating under layer and the charge-transporting top layer. In those embodiments in which the photoconductive element contains two charge-transporting layers, either identical or different layers, the blocking screen may be disposed between these two layers. Preferably, the blocking screen is electrically insulating, but materials having more conductivity may be used to form the screen as long as they act as a barrier to charge carriers at the interface between adjoining layers.

The photoconductive first areas and the non-photoconductive second areas in the electrophotographic element may form a regular or irregular pattern. An example of a regular pattern is a screen or grid of intersecting lines. Preferably the photoconductive first areas would form the lines of the screen or grid with the space between the lines forming the non-photoconductive second areas. This embodiment of the regular screen or grid is preferable because it enables one to obtain the greatest uniformity of light-grey parts in the image.

The smallest diameter of the non-photoconductive second areas is not critical but is preferably between about 5 μm and 100 μm. A contributing factor in determining the smallest diameter is the development speed of the process. If the electrophotographic element is transported through the developing zone at a speed of 5 m per minute, the smallest diameter of the non-photoconductive second areas generally cannot be less than 5 μm. If, however, the electrophotographic element is transported through the developing zone more slowly then smaller diameters are possible. The largest size for the non-photoconductive second areas is determined by the visibility limit. Areas having a smallest diameter above 100 μm are visible to the naked eye in the form of dots and lines and are, therefore, undesirable.

The total area of the electrophotographic element covered by the non-photoconductive second areas depends upon the density with which grey areas are required to be reproduced. Preferably the area covered by the non-photoconductive second areas is between 5% and 25% of the total area. A percentage smaller than 5% is possible but the favorable effects of the invention start to decrease as the percentage decreases. A percentage above 25% is usable, but is unnecessary and in fact is less desirable than the preferred range due to the increasing light-sensitivity loss caused by having a larger non-photoconductive area.

The support used in the electrophotographic element may consist of any conventional material. A typical suitable material is anodized aluminum. Another suitable material is a polyester film covered by a conductive layer such as an aluminum layer or a layer consisting of a dispersion of carbon in a binder. Any pattern in the aluminum layer on the polyester film can be obtained by etching away those parts of the layer which have not been covered. Similarly any pattern in the carbon-binder layer can be obtained by pressing the required pattern into the film in the form of pits or grooves and filling these grooves or pits with the carbon-binder dispersion.

Still another way of producing a pattern on the continuous conductive layer is by printing thereon a thin electrically insulating polymeric layer in the desired pattern.

The charge-generating layer of the electrophotographic element preferably consists of a vapor-coated or binder-dispersed charged-generating substance such as a bisazo pigment, phthalocyanine, a perylene dye, silicon or selenium. The preferred vapor-coated charge-generating substance is N,N'-dibenzyl-perylene-3,4;9,10-tetracarboxylic acid diimide. Bisazo pigments are the preferred charge-generating substances for a dispersion in a binder such as cellulose acetate butyrate. Bisazo pigments of which Fenelac blue, also known as Diane Blue (CI 21180), is a good representative, are mentioned in United Kingdom Pat. No. 1,370,197. Other suitable bisazo pigments are the stilbene bisazo-naphthols which are described in United Kingdom Pat. No. 1,520,590. Suitable representatives of the stilbene bisazo-naphthols are 3,3'-dichloro-4,4'-bis(2"-hydroxy-3"-anilinocarbonyl-naphthylazo)-stilbene and 4,4'-bis(-2"-hydroxy-3"-isopropylaminocarbonyl-naphythylazo)-stilbene.

The charge-generating layers described above can be made in the form of a screen, by removing, e.g., with a laser, part of the charge-generating layer in a dot pattern or in a pattern of intersecting lines. Conversely, the charge-generating layer can be applied to the support of the electrophotographic element in a line or dot pattern by printing techniques such as intaglio or screen printing. If a vapor-coated layer is used, a temporary screen can be applied to the support which is removed after the charge-generating substance is vapor-coated.

The charge-generating layer can also be obtained by coating the support with a charge-generating substance such as a bisazo dye. To do this, a solution of a plastic and a diazonium salt is placed as a layer on the support. After drying, this layer is exposed to light through a line or dot screen and the non-exposed and hence non-decomposed diazonium salt is converted into the charge-generating substance by treatment with a suitale azo-compound in an alkaline medium. Examples of diazonium salts and azo-compounds which can be used in this way to form a pattern of charge-generating bisazo dyes are described in United Kingdom Pat. No. 2,031,176.

There is no need to make the charge-generating layer in the form of a screen or grid if there is already a screen or grid present on the support or if an electrically insulting polymer is applied in a pattern to the charge-generating layer. The polymer can be applied by screen printing or by means of a photo-sensitive varnish which is exposed to light in the required pattern and is then selectively washed away from the non-exposed places.

The charge-transporting top layer contains an arbitrary charge-transport substance having a long transit length for charge carriers. Examples of charge-transporting substances are N-alkylcarbazoles, oxadiazoles, triphenyl methane diamines, azines and hydrazones which are applied by means of a polymeric binder. If required, the top layer may also contain an activator such as 1,3,7-trinitro-dibenzothiophene-5,5-dioxide or terephthalal dimalonic nitrile. The preferable charge-transport substances are the azines, more particularly described in European Patent Application No. 85,447 and the hydrazones, more particularly described in German Patent Application No. 2,919,791. The azines, in particular, form excellent charge-transporting top layers, especially when used together with terephthalal dimalonic nitrile in the form of a solution in a polycarbonate.

The charge-generating layer and the charge-transporting layer can have any thicknesses conventionally used for double layer systems. The charge-generating layer, however, is preferably not thicker than 1 μm, but this thickness is not critical or limiting. A thickness of 0.1 μm to 0.3 μm has already been tested and a thickness of 3 μm is possible but unnecessary.

The charge-transporting top layer should be thicker than the underlying charge-generating layer. The preferred thickness for the charge-transporting top layer is about 5 μm but this thickness is not critical either. For example, a smaller thickness of 1 μm has already been tested. Moreover, a thickness of 20 μm or more is possible in principle but would be unnecessary.

The electrophotographic element is typically charged by corona in the manner conventionally used in electrophotography. Preferably, the charging is done by a scorotron which uniformly charges the electrophotographic element to a specific percentage of the maximum potential. Charging to 40%–60% of the maximum potential is preferred because under these charging conditions the life of the electrophotographic element is prolonged.

After image-wise exposure of the electrophotographic element, the developing powder is brought into contact with the element by means of a donor surface which preferably consists of a rotatable cylinder in which stationary magnets are disposed. The developing powder has a resistivity of less than $10^{12}$ ohms·cm with the preferable range of resistivity being between $10^6$ and $10^{10}$ ohms cm.

The developing powder consists of a conductive material included in a plastic. Conventional plastics for electrophotographic developers include epoxy resin, modified epoxy resin, polyester resin and styrene acrylate copolymer. Conductive developers are generally used in the form of a so-called one-component developer and a magnetizable material such as magnetite or ferrite, is also included int he powder particles. As is conventional in electrophotography, developing powders having rounded particles with a low diameter spread are preferred.

The developed powder image is then transferred in a manner conventional in electrophotography, onto a suitable receiving material, such as paper, and fixed thereon. The transfer onto paper can be carried ou directly by means of an electric field or indirectly by a silicone rubber intermediate.

The present invention will be explained in detail by reference to the following example.

EXAMPLE

A solution of 1.2 g of cellulose acetate butyrate in 60 ml of acetone was mixed with a solution of 1 g of 2-hydroxy-N-phenyl-3-naphthalene carboxamide in 13 ml of N,N-dimethylformamide. A solution of 0.5 g of the 4,4'-bisdiazonium boron fluoride salt of 3,3'-dimethoxybiphenyl in 7 ml of N,N-dimethyl formamide was added to the mixture. A plastic film coated with aluminum was covered with the resulting mixture on the aluminum-coated side. The layer, obtained after drying the resulting mixture, had a thickness of 0.5 μm. The layer was then covered with a screen of perpendicularly intersecting lines having a diameter of 60 μm. The openings in the screen between the lines had a diameter of 25 μm and all the openings together occupied 16% of the total surface area of the screen. The layer was exposed to light through the screen and after removal of the screen was treated with ammonia forming, in the non-exposed locations the charge-generating substance 3,3'-dimethoxy-4,4'-bis(2''-hydroxy-3''-aminocarbonyl naphthylazo-)biphenyl in a form so finely divided that it was impossible to distinguish the particles.

A charge-transporting top layer of the following composition was applied to the previously formed charge-generating layer:

25 ml of a 10% by weight solution of a polycarbonate (Lexan 141 of General Electric) in 1,2-dichloroethane;

8 ml of tetrahydrofuran;

0.025 g of terephthalal dimalonic nitrile; and 1.5 g of an azine of the following formula:

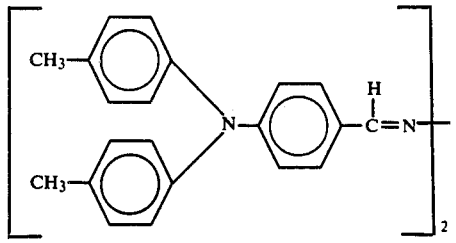

The resulting top layer had a thickness of 5 μm after drying.

The photoconductive element obtained by the above example was exposed image-wise to an original which in addition to black areas had various grey areas (one grey step) on a white background. The charge image produced by the image-wise exposure was developed using a conventional copier having a magnetic brush developing device. A one-component developing powder was used containing a magnetizable material and carbon-coated resin particles of a diameter of 20 μm to 30 μm. The resistivity of the developing powder was $10^8$ ohms·cm. The image obtained after transfer and fixing of the powder image on a sheet of paper had uniform black areas on a white background in addition to very uniform light-grey areas, just as in the original.

While presently preferred embodiments of the invention have been described and illustrated in particularity, the invention may be otherwise embodied within the scope of the appended claims.

What is claimed is:

1. A process for producing copies in which:

(a) a charge image with a pattern of charged and uncharged areas superimposed thereon is formed by charging and exposing image-wise an electrophotographic layer and therebeneath a charge-generating layer which upon exposure injects charges into a plurality of first areas of the charge-transporting top layer but does not inject charges into a plurality of second areas of the charge-transporting layer;

(b) the charge image is developed into a powder image with a developing powder having a resistivity of less than $10^{12}$ ohms·cm; and (c) the powder image is transferred to a receiving material and is fixed thereon.

2. A process according to claim 1, wherein the charge-transporting top layer of the electrophotographic element is in charge-injecting contact with the charge-generating layer in the first areas but is not in such contact in the second areas.

3. A process according to claim 1, wherein the charge-generating layer of the electrophotographic element is interrupted corresponding to the second areas of the charge-transporting layer.

4. A process according to claim 1, wherein the charge-generating layer of the electrophotographic element contains a charge-generating substance only in the areas corresponding to the first areas of the charge-transporting layer.

5. A process according to claim 1, wherein the electrophotographic element further comprises, between the charge-generating layer and the charge-transporting top layer, a screen which prevents charge-injecting contact between the layers in the second areas.

6. A process according to claims 1, 2, 3, 4 or 5, wherein the second areas of the charge-transporting layer of the electrophotographic element have a diameter of between 5 μm and 100 μm and together cover between 5% and 25% of the total area of the electrophotographic element.

* * * * *

UNITED STATES PATENT AND TRADEMARK OFFICE

CERTIFICATE OF CORRECTION

PATENT NO. : 4,587,193

DATED : May 6, 1986

INVENTOR(S) : Roelof H. Everhardus, Theodorus J. H. Siebers and Martinus B. G. M. Biermans It is certified that error appears in the above-identified patent and that said Letters Patent are hereby corrected as shown below:

Column 4, line 58, delete "suitale" and substitute therefor -- suitable --

Column 5, line 66, delete "ou" and substitute therefor -- out --

Column 7, line 2, after "electrophotographic" insert -- element comprising a support, a charge-transporting top --

Signed and Sealed this

Twenty-seventh Day of January, 1987

*Attest:*

DONALD J. QUIGG

*Attesting Officer*

*Commissioner of Patents and Trademarks*